US012448244B2

(12) United States Patent
Shibuya

(10) Patent No.: US 12,448,244 B2
(45) Date of Patent: Oct. 21, 2025

(54) TRANSPORT DEVICE AND RECORDING DEVICE

(71) Applicant: SEIKO EPSON CORPORATION, Tokyo (JP)

(72) Inventor: Junya Shibuya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 91 days.

(21) Appl. No.: 18/305,517

(22) Filed: Apr. 24, 2023

(65) Prior Publication Data

US 2023/0339711 A1 Oct. 26, 2023

(30) Foreign Application Priority Data

Apr. 23, 2022 (JP) ..... 2022-071213

(51) Int. Cl.
*B65H 9/00* (2006.01)

(52) U.S. Cl.
CPC ..... *B65H 9/004* (2013.01); *B65H 9/006* (2013.01); *B65H 2301/331* (2013.01); *B65H 2404/6111* (2013.01); *B65H 2513/10* (2013.01); *B65H 2513/20* (2013.01); *B65H 2601/521* (2013.01); *B65H 2801/06* (2013.01)

(58) Field of Classification Search
CPC .. B65H 9/004; B65H 2301/331; B65H 9/006; B65H 9/06; B65H 2404/7231; B65H 2404/7232; B65H 2404/725; B65H 2601/521
See application file for complete search history.

(56) References Cited

U.S. PATENT DOCUMENTS 7,731,175 B2 * 6/2010 Kang ..... B41J 11/009 271/245
8,905,537 B2 * 12/2014 Lo ..... B65H 5/062 347/104
2008/0143045 A1 * 6/2008 Yu ..... B65H 9/06 271/245
2020/0369484 A1 11/2020 Suzuki et al.

FOREIGN PATENT DOCUMENTS

JP 2020-189731 A 11/2020

* cited by examiner

*Primary Examiner* — Jeremy R Severson
(74) *Attorney, Agent, or Firm* — WORKMAN NYDEGGER

(57) ABSTRACT

A transport device includes a skew correction unit configured to correct skew of a medium by colliding with the medium and a buffer unit provided with a contact portion configured to come into contact with the medium between a first transport unit transporting the medium to the skew correction unit and the skew correction unit in a transport direction. The buffer unit is configured such that a second transport velocity is lower than a first transport velocity, the first transport velocity being a transport velocity of the medium upstream of the buffer unit in the transport direction, the second transport velocity being a transport velocity of the medium when the medium collides with the skew correction unit after coming into contact with the contact portion. The buffer unit is configured such that the contact portion does not collide with the medium strongly enough to correct the skew of the medium.

18 Claims, 9 Drawing Sheets

TRANSPORT DEVICE AND RECORDING DEVICE

The present application is based on, and claims priority from JP Application Serial Number 2022-071213, filed Apr. 23, 2022, the disclosure of which is hereby incorporated by reference herein in its entirety.

BACKGROUND

1. Technical Field

The present disclosure relates to a transport device and a recording device.

2. Related Art

Transport devices having various configurations such as a recording device represented by a printer have been used. Some of the transport devices can correct skew of a transported medium. For example, JP-A-2020-189731 discloses a transport device that corrects skew of a transported sheet having a size smaller than a predetermined size by causing the sheet to collide with a third claw portion and corrects skew of a transported sheet having the predetermined size or more by causing the sheet to collide with the third claw portion and then collide with a first claw portion and a second claw portion.

However, the related-art transport devices capable of correcting the skew of the transported medium make a large sound when correcting the skew of the medium. This sound is made when the transported medium collides with a skew correction unit. In the case where the transport device according to JP-A-2020-189731 transports the sheet having a size smaller than the predetermined size, a large sound is made when the sheet being the medium collides with the third claw portion serving as the skew correction unit. In the case where the transport device according to JP-A-2020-189731 transports the sheet having the predetermined size or more, a large sound is made both when the sheet being the medium collides with the third claw portion serving as the skew correction unit and when the sheet collides with the first claw portion and the second claw portion serving as the skew correction unit. Here, when the transport device according to JP-A-2020-189731 transports the sheet having the predetermined size or more, the sheet once collides with the third claw portion and then collides with the first claw portion and the second claw portion. Thus, the sound made when the sheet collides with the first claw portion and the second claw portion tends to be small. However, the sound made when the sheet collides with the third claw portion serving as the skew correction unit is large, and from the viewpoint of the total of the sound made when the sheet collides with the third claw portion and the sound made when the sheet collides with the first claw portion and the second claw portion, it can be said that a large sound is made when the skew of the medium is corrected.

SUMMARY

A transport device according to the present disclosure for solving the above problem is a transport device for transporting a medium, the transport device including a skew correction unit configured to correct skew of the medium by colliding with the medium transported, a first transport unit configured to transport the medium to the skew correction unit, and a buffer unit provided with a contact portion configured to come into contact with the medium between the first transport unit and the skew correction unit in a transport direction of the medium, wherein the buffer unit is configured such that a second transport velocity is lower than a first transport velocity, the first transport velocity being a transport velocity of the medium upstream of the buffer unit in the transport direction, the second transport velocity being a transport velocity of the medium when the medium collides with the skew correction unit after coming into contact with the contact portion and the buffer unit is configured such that the contact portion does not collide with the medium strongly enough to correct the skew of the medium.

DESCRIPTION OF EXEMPLARY EMBODIMENTS

Figure 1:
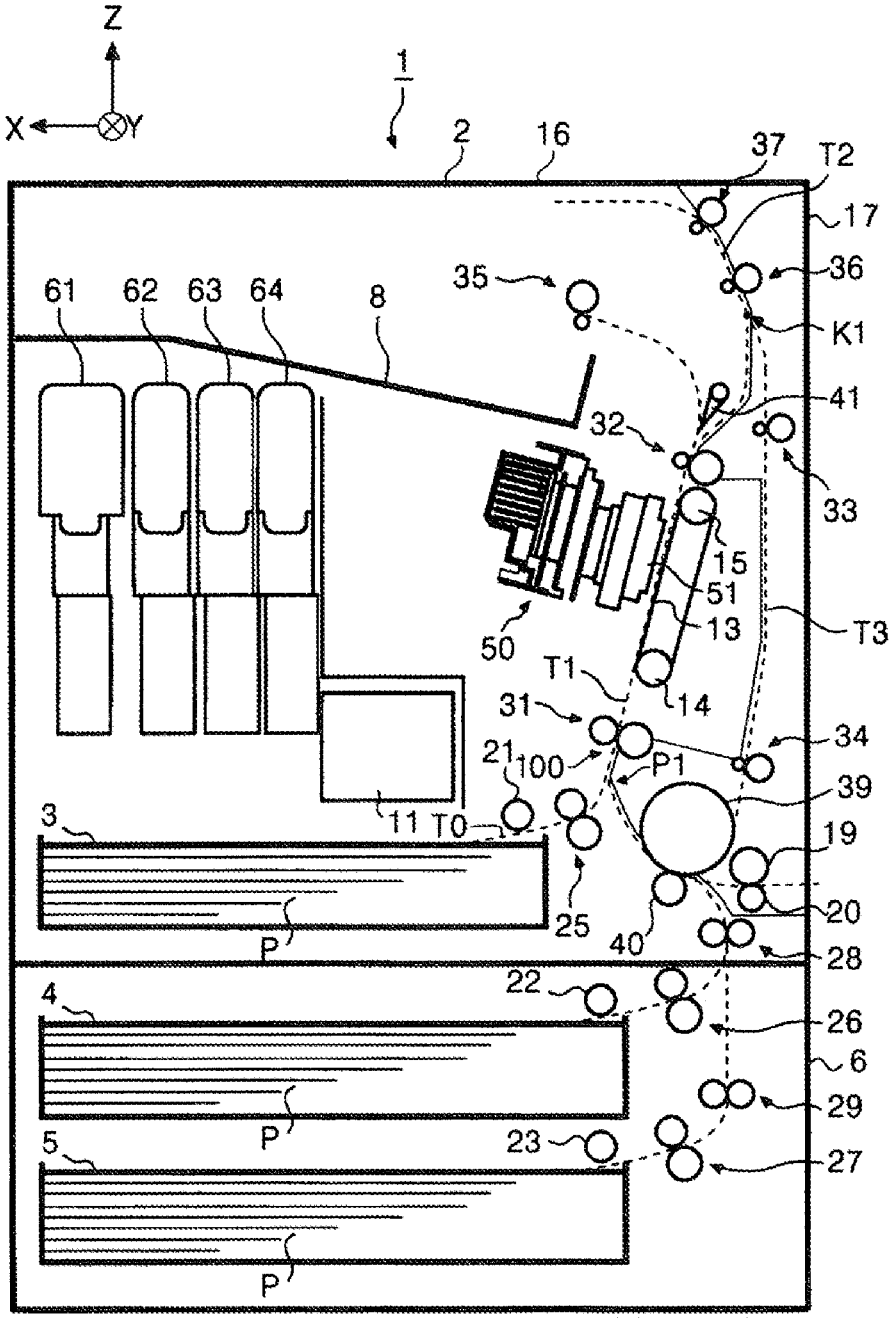
FIG. 1 is a front view illustrating an internal configuration of a printer according to Embodiment 1 of the present disclosure.

The present disclosure will be schematically described below.

A transport device according to a first aspect of the present disclosure is a transport device for transporting a medium, the transport device including a skew correction unit configured to correct skew of the medium by colliding with the medium transported, a first transport unit configured to transport the medium to the skew correction unit, and a buffer unit provided with a contact portion configured to come into contact with the medium between the first transport unit and the skew correction unit in a transport direction of the medium, wherein the buffer unit is configured such that a second transport velocity is lower than a first transport velocity, the first transport velocity being a transport velocity of the medium upstream of the buffer unit in the transport direction, the second transport velocity being a transport velocity of the medium when the medium collides with the skew correction unit after coming into contact with the contact portion and the buffer unit is configured such that the contact portion does not collide with the medium strongly enough to correct the skew of the medium.

According to this aspect, the buffer unit is configured such that the second transport velocity is lower than the first transport velocity and is configured such that the contact portion does not collide with the medium strongly enough to correct the skew of the medium. For this reason, it is possible to suppress strong collision of the medium with the skew correction unit when the skew of the medium is corrected and also suppress strong collision of the medium with the contact portion of the buffer unit. Thus, it is possible to reduce a sound made when the skew of the medium is corrected.

The transport device according to a second aspect of the present disclosure is the transport device according to the first aspect wherein the buffer unit includes a contact force reduction portion configured to reduce a contact force when the contact portion and the medium are in contact with each other.

According to this aspect, the buffer unit includes the contact force reduction portion configured to reduce the contact force when the contact portion and the medium are in contact with each other. For this reason, the contact force reduction portion can suppress strong collision of the medium with the skew correction unit when the skew of the medium is corrected and also suppress strong collision of the medium with the contact portion of the buffer unit.

The transport device according to a third aspect of the present disclosure is the transport device according to the second aspect wherein the contact force reduction portion includes an elastic member configured to bias the contact portion in a direction opposite to the transport direction.

According to this aspect, the contact force reduction portion includes the elastic member configured to bias the contact portion in the direction opposite to the transport direction. For this reason, for example, the biasing force of the elastic member can suitably decelerate the medium P and return the contact portion to a position where the contact portion and the medium start to come into contact with each other, which is an initial position.

The transport device according to a fourth aspect of the present disclosure is the transport device according to the second aspect wherein the contact force reduction portion includes a damper configured to damp a motion of the contact portion in the transport direction.

According to this aspect, the contact force reduction portion includes the damper configured to damp the motion of the contact portion in the transport direction. For this reason, for example, the damper can suitably decelerate the medium.

The transport device according to a fifth aspect of the present disclosure is the transport device according to the second aspect wherein the contact force reduction portion includes a displacement unit configured to move the contact portion from a contact start position where the contact portion and the medium come into contact with each other to a retraction position where the contact portion and the medium do not come into contact with each other and the displacement unit is configured to move the contact portion such that the transport velocity of the medium is a transport velocity lower than the first transport velocity when the contact portion is moved from the contact start position to the retraction position and is configured to return the contact portion from the retraction position to the contact start position.

According to this aspect, the contact force reduction portion includes the displacement unit configured to move the contact portion from the contact start position to the retraction position, and the displacement unit is configured to move the contact portion such that the transport velocity of the medium is a transport velocity lower than the first transport velocity and is configured to return the contact portion from the retraction position to the contact start position. For this reason, for example, the displacement unit such as a solenoid can suitably decelerate the medium and return the contact portion to the position where the contact portion and the medium start to come into contact with each other, which is the initial position.

The transport device according to a sixth aspect of the present disclosure is the transport device according to the second aspect wherein the contact force reduction portion includes a flexible member.

According to this aspect, the contact force reduction portion includes the flexible member. For this reason, for example, use of the flexible member makes it possible to easily and inexpensively form a configuration of suitably decelerating the medium and a configuration of returning the contact portion to the position where the contact portion and the medium start to come into contact with each other, which is the initial position.

The transport device according to a seventh aspect of the present disclosure is the transport device according to any one of the first to sixth aspects wherein the skew correction unit is a roller pair including a first roller and a second roller facing the first roller.

According to this aspect, the skew correction unit is the roller pair. For this reason, for example, it is possible to correct the skew at the nip point of the roller pair or the like and cause the skew correction unit to also serve as the transport unit of the medium.

The transport device according to an eighth aspect of the present disclosure is the transport device according to the seventh aspect wherein the contact portion is configured to rotate coaxially with the first roller.

According to this aspect, the contact portion is configured to rotate coaxially with the first roller. For this reason, it is possible to shorten the distance between the contact start position of the medium and the contact portion and the collision position of the medium and the skew correction unit, shorten the time from when the medium starts to come into contact with the contact portion to when the medium collides with the skew correction unit, and suppress a decrease in throughput.

The transport device according to a ninth aspect of the present disclosure is the transport device according to the seventh aspect wherein at least one of the first roller or the second roller is a toothed roller configured to come into contact with the medium at a tooth portion.

According to this aspect, at least one of the first roller or the second roller is the toothed roller. In general, use of the toothed roller as the skew correction unit tends to make a collision sound of the medium large. However, providing the buffer unit can reduce a sound made when the skew of the medium is corrected.

The transport device according to a tenth aspect of the present disclosure is the transport device according to the seventh aspect wherein a plurality of the buffer units and a plurality of the first rollers are alternately arranged in an axial direction of the plurality of first rollers.

According to this aspect, the plurality of buffer units and the plurality of first rollers are alternately provided in the axial direction of the plurality of first rollers. For this reason, it is possible to reduce a sound made when the skew of media having various sizes is corrected while suitably correcting the skew of the media. In particular, when a large medium is used, by providing the plurality of buffer units and the plurality of first rollers alternately in the axial direction of the plurality of first rollers, it is possible to suitably and effectively correct the skew of the medium and reduce a sound made when the skew of the medium is corrected.

The transport device according to an eleventh aspect of the present disclosure is the transport device according to any one of the first to sixth aspects wherein the skew correction unit is a gate unit configured to be displaced between a collision position where the medium transported collides with the gate unit and a passing position for passing the medium transported.

According to this aspect, the skew correction unit is the gate unit configured to be displaced between the collision position where the medium transported collides with the gate unit and the passing position for passing the medium transported. For this reason, in the configuration of correcting the skew using the gate unit, it is possible to reduce a sound made when the skew of the medium is corrected.

The transport device according to a twelfth aspect of the present disclosure is the transport device according to the eleventh aspect wherein the gate unit is configured to be displaced between the collision position and the passing position by rotating about, as a rotation axis, a direction intersecting the transport direction and the contact portion is configured to rotate coaxially with the gate unit.

According to this aspect, the gate unit is configured to be displaced between the collision position and the passing position by rotating about, as the rotation axis, the direction intersecting the transport direction and the contact portion is configured to rotate coaxially with the gate unit. For this reason, it is possible to shorten the distance between the contact start position of the medium and the contact portion and the collision position of the medium and the skew correction unit, shorten the time from when the medium starts to come into contact with the contact portion to when the medium collides with the skew correction unit, and suppress a decrease in throughput.

The transport device according to a thirteenth aspect of the present disclosure is the transport device according to the third aspect wherein the skew correction unit is a gate unit configured to be displaced between a collision position where the medium transported collides with the gate unit and a passing position for passing the medium transported, the gate unit is configured to be displaced between the collision position and the passing position by rotating about, as a rotation axis, a direction intersecting the transport direction, the contact portion is biased by the contact force reduction portion at a first biasing force in a direction opposite to the transport direction, the gate unit is biased at a second biasing force in a direction opposite to the transport direction, and the first biasing force is smaller than the second biasing force.

According to this aspect, the contact portion is biased at the first biasing force in the direction opposite to the transport direction, the gate unit is biased at the second biasing force in the direction opposite to the transport direction, and the first biasing force is smaller than the second biasing force. For this reason, for example, it is possible to prevent the contact portion from abutting on the medium and stopping the medium so as to push back the medium and reduce a sound made when the skew of the medium is corrected.

The transport device according to a fourteenth aspect of the present disclosure is the transport device according to any one of the first to thirteenth aspects wherein the contact portion extends from a proximal end portion to a distal end portion configured to come into contact with the medium and the distal end portion extends downstream of the proximal end portion in the transport direction.

According to this aspect, the distal end portion of the contact portion configured to come into contact with the medium extends downstream of the proximal end portion in the transport direction. For this reason, it is possible to suppress a situation in which the transported medium unintentionally strongly collides with the contact portion and makes a large collision sound. In particular, since the medium collides obliquely with the contact portion, it is possible to suppress a collision sound as compared with a case where the medium collides at a right angle. In addition, the transport of the medium is not hindered as compared with a case where the distal end portion extends upstream of the proximal end portion in the transport direction.

The transport device according to a fifteenth aspect of the present disclosure is the transport device according to any one of the first to fourteenth aspects further including a second transport unit downstream of the skew correction unit in the transport direction, the second transport unit being configured to transport the medium, wherein a third transport velocity is higher than the second transport velocity, the third transport velocity being a transport velocity of the medium by the second transport unit after the skew is corrected by the skew correction unit.

According to this aspect, the third transport velocity is higher than the second transport velocity, the third transport velocity being the transport velocity of the medium by the second transport unit after the skew is corrected by the skew correction unit. For this reason, it is possible to suppress a decrease in throughput by subsequently recovering the transport velocity of the medium while reducing a sound made when the skew of the medium is corrected.

A recording device according to a sixteenth aspect of the present disclosure includes the transport device according to any one of the first to fifteenth aspects and a recording unit configured to perform recording on the medium transported by the transport device.

According to this aspect, the recording device includes the recording unit configured to perform the recording on the medium. For this reason, when the recording is performed on the medium, it is possible to reduce a sound made when the skew of the medium is corrected. That is, it is possible to reduce a sound made when the skew of the medium is corrected while improving recording accuracy by correcting the skew of the medium.

Embodiment 1

The present disclosure will be specifically described below. First, an inkjet printer 1 according to Embodiment 1, which is a transport device and also a recording device according to the present disclosure, will be described. Hereinafter, the inkjet printer 1 is simply referred to as a printer 1. An XYZ coordinate system illustrated in each drawing is an orthogonal coordinate system. A Y-axis direction is a direction intersecting a transport direction of a medium P, that is, a medium width direction and is also a device depth direction. Of the Y-axis direction, a +Y direction is a direction from a device front surface toward a device back surface, and a −Y direction is a direction from the device back surface toward the device front surface.

An X-axis direction is a device width direction. A +X direction is the left and a −X direction is the right when viewed from an operator of the printer 1. A Z-axis direction is a vertical direction, that is, a device height direction. A +Z direction is an upward direction and a −Z direction is a downward direction. In the description below, a direction in which the medium P is transported may be referred to as "downstream" and a direction opposite thereto may be referred to as "upstream". In each drawing, a medium transport path is indicated by a dashed line. In the printer 1, the medium P is transported along the medium transport path indicated by the dashed line.

As illustrated in FIG. 1, the printer 1 includes a housing unit 16 of a device main body 2, and a door unit 17 rotatable about a shaft (not illustrated) extending in the Z-axis direction with respect to the housing unit 16 as a rotation shaft. The printer 1 further includes a first medium cassette 3 accommodating the medium P at a lower part of the device main body 2 and is configured such that an additional unit 6 can be coupled to a lower side of the device main body 2. When the additional unit 6 is coupled, a second medium cassette 4 and a third medium cassette 5 are positioned below the first medium cassette 3. The medium P fed from each medium cassette is transported along the medium transport path indicated by the dashed line inside the printer 1.

Each medium cassette is provided with a pick-up roller that feeds the accommodated medium P in the −X direction. Pick-up rollers 21, 22, and 23 are provided at the first medium cassette 3, the second medium cassette 4, and the third medium cassette 5, respectively. Each medium cassette is provided with a feed roller pair that feeds, in an obliquely upward direction, the medium P that has been fed in the −X direction. Feed roller pairs 25, 26, and 27 are provided at the first medium cassette 3, the second medium cassette 4, and the third medium cassette 5, respectively. In the following description, a "roller pair" includes a driving roller driven by a motor (not illustrated) and a driven roller that is driven to rotate in contact with the driving roller, unless otherwise specified.

The medium P that has been fed from the third medium cassette 5 is fed to a reversing roller 39 by transport roller pairs 29 and 28. The medium P that has been fed from the second medium cassette 4 is fed to the reversing roller 39 by the transport roller pair 28. The medium P is nipped by the reversing roller 39 and a driven roller 40 and is fed to a transport roller pair 31. The medium P that has been fed from the first medium cassette 3 is fed to the transport roller pair 31 without passing through the reversing roller 39. Here, although details will be described later, the transport roller pair 31 serves as the skew correction unit, and the periphery of the transport roller pair 31 forms a skew correction portion 100, which is a main unit of the printer 1 according to the embodiment. A supply roller 19 and a separation roller 20 provided in the vicinity of the reversing roller 39 are a roller pair that feeds the medium P from a supply tray (not illustrated).

The medium P receiving a transport force from the transport roller pair 31 is fed to a position between a line head 51, which is one example of the recording unit, and a transport belt 13, that is, a recording position facing the line head 51. A medium transport path from the transport roller pair 31 to a transport roller pair 32 is hereinafter referred to as a recording-time transport path T1.

The line head 51 constitutes a head unit 50. The line head 51 performs recording by ejecting ink, which is one example of liquid, to a surface of the medium P. The line head 51 is an ink ejection head configured such that nozzles for ejecting ink cover the entire region in the medium width direction and is configured as an ink ejection head capable of recording on the entire region in the medium width direction without moving in the medium width direction. However, the ink ejection head is not limited thereto and may be of a type that is mounted at a carriage and that ejects ink while moving in the medium width direction. In addition, it is also possible to use a recording unit having a configuration other than the ink ejection head, such as a recording unit of a thermal transfer system.

The printer 1 includes ink accommodation units 61, 62, 63, and 64 as liquid accommodation units. Ink ejected from the line head 51 is supplied from each ink accommodation unit to the line head 51 via a tube (not illustrated). Each of the ink accommodation units is detachably provided. The printer 1 further includes a waste liquid accommodation unit 11 that stores ink as waste liquid ejected from the line head 51 toward a flushing cap (not illustrated) for maintenance.

The transport belt 13 is an endless belt wound around a pulley 14 and a pulley 15. At least one of the pulley 14 or the pulley 15 is driven by a motor (not illustrated), so that the transport belt 13 is rotated. The medium P is transported to a position facing the line head 51 while being made to cling to the belt surface of the transport belt 13. A known method such as an air suction method or an electrostatic chuck method can be employed to cause the medium P to cling to the transport belt 13.

The recording-time transport path T1 passing through the position facing the line head 51 is configured to form an angle with respect to the horizontal and vertical directions and transport the medium P upward. This upward transport direction is a direction including a −X direction component and a +Z direction component in FIG. 1, and such a configuration can suppress the horizontal dimension of the printer 1.

The medium P including a first surface on which recording has been performed by the line head 51 is further transported upward by the transport roller pair 32 located downstream of the transport belt 13. A flap 41 is provided downstream of the transport roller pair 32, and this flap 41 switches the transport direction of the medium P. When the medium P is discharged as it is, the transport path of the medium P is switched by the flap 41 so as to be directed toward a transport roller pair 35 above the flap 41, and the medium P is discharged toward a discharge tray 8 by the transport roller pair 35.

When recording is further performed on, in addition to the first surface of the medium P, a second surface opposite to the first surface, the flap 41 switches the transport direction of the medium P toward a branching position K1. The medium P passes through the branching position K1 and enters a switchback path T2. In the embodiment, the switchback path T2 is a medium transport path above the branching position K1. Transport roller pairs 36 and 37 are provided at the switchback path T2. The transport roller pairs 36 and 37 transport the medium P that has entered the switchback path T2 upward. When the rear edge of the medium P passes through the branching position K1, the rotation directions of the transport roller pairs 36 and 37 are switched, so that the medium P is transported downward. Note that the term "upward" does not only mean the vertically upward direction but also means a direction including a vector component of the vertically upward direction and the term "downward"

does not only mean the vertically downward direction but also means a direction including a vector component of the vertically downward direction.

The switchback path T2 is coupled to a reversing path T3. In the embodiment, the reversing path T3 is a medium transport path from the branching position K1 to a merging point P1 through transport roller pairs 33 and 34 and the reversing roller 39. The medium P transported downward from the branching position K1 receives a transport force from the transport roller pairs 33 and 34, reaches the reversing roller 39, is reversed while being curved by the reversing roller 39, and then is fed to the transport roller pair 31.

Regarding the medium P transported by the transport roller pair 31 and the like and fed to the position facing the line head 51 again, the second surface opposite to the first surface on which recording has already been performed faces the line head 51. This enables the line head 51 to perform recording on the second surface of the medium P. Here, a medium transport path from the first medium cassette 3 to the transport roller pair 31 is referred to as a feed path T0.

Next, the skew correction portion 100, which is a main unit of the printer 1 according to the embodiment, will be described in detail with reference to FIGS. 2 to 5. As illustrated in FIGS. 2 to 5, the skew correction portion 100 according to the embodiment includes the transport roller pair 31 serving as the skew correction unit, and the transport roller pair 31 includes a first roller 311 and a second roller 312 facing the first roller 311. The transport roller pair 31 causes the leading end portion of the transported medium P in a transport direction A to collide with the nip position of the first roller 311 and the second roller 312. Thus, the leading end portion follows the nip position in the Y-axis direction, thereby correcting the skew of the transported medium P.

Figure 2:
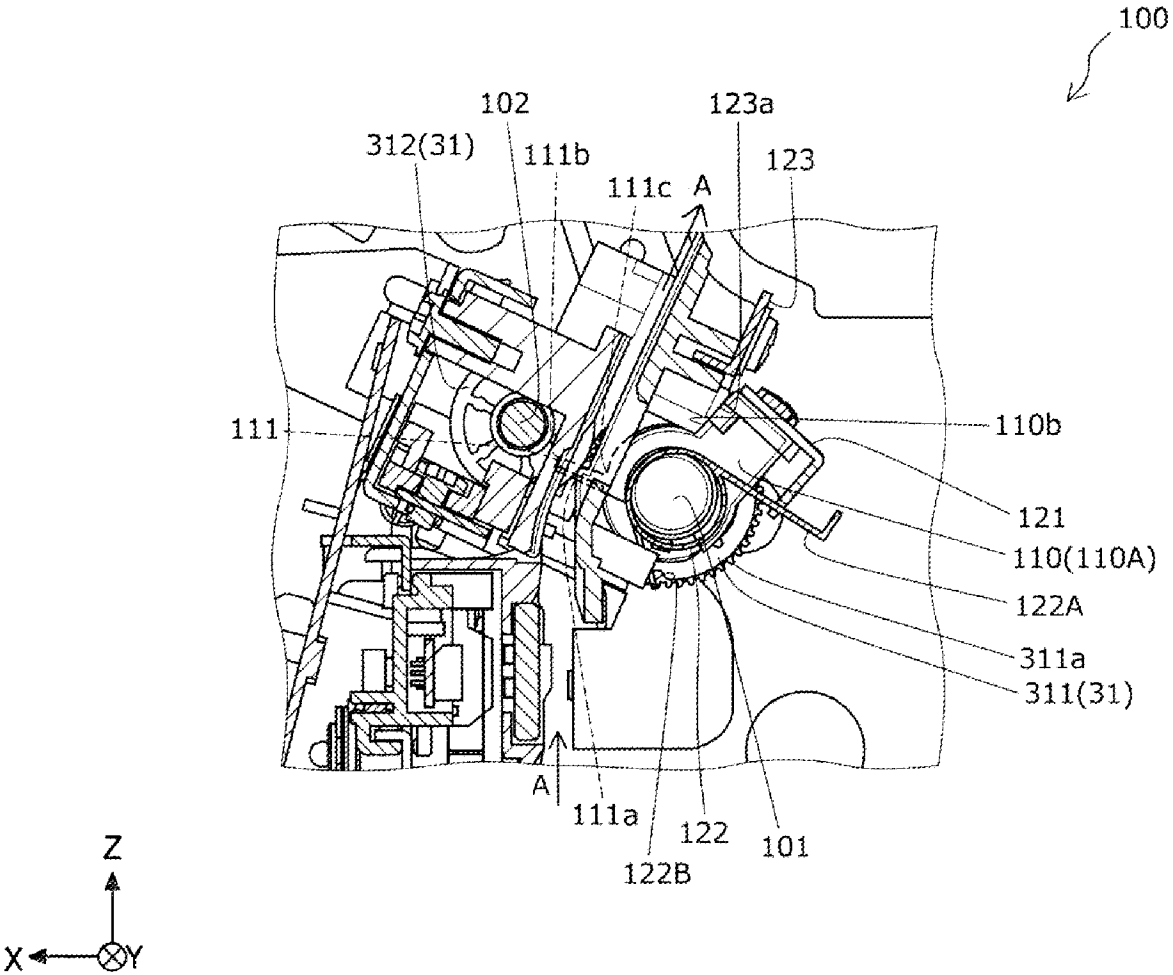
FIG. 2 is a front cross-sectional view illustrating a skew correction portion of the printer of FIG. 1 and a view illustrating a state in which a contact portion is at a position in contact with a transported medium.
Figure 4:
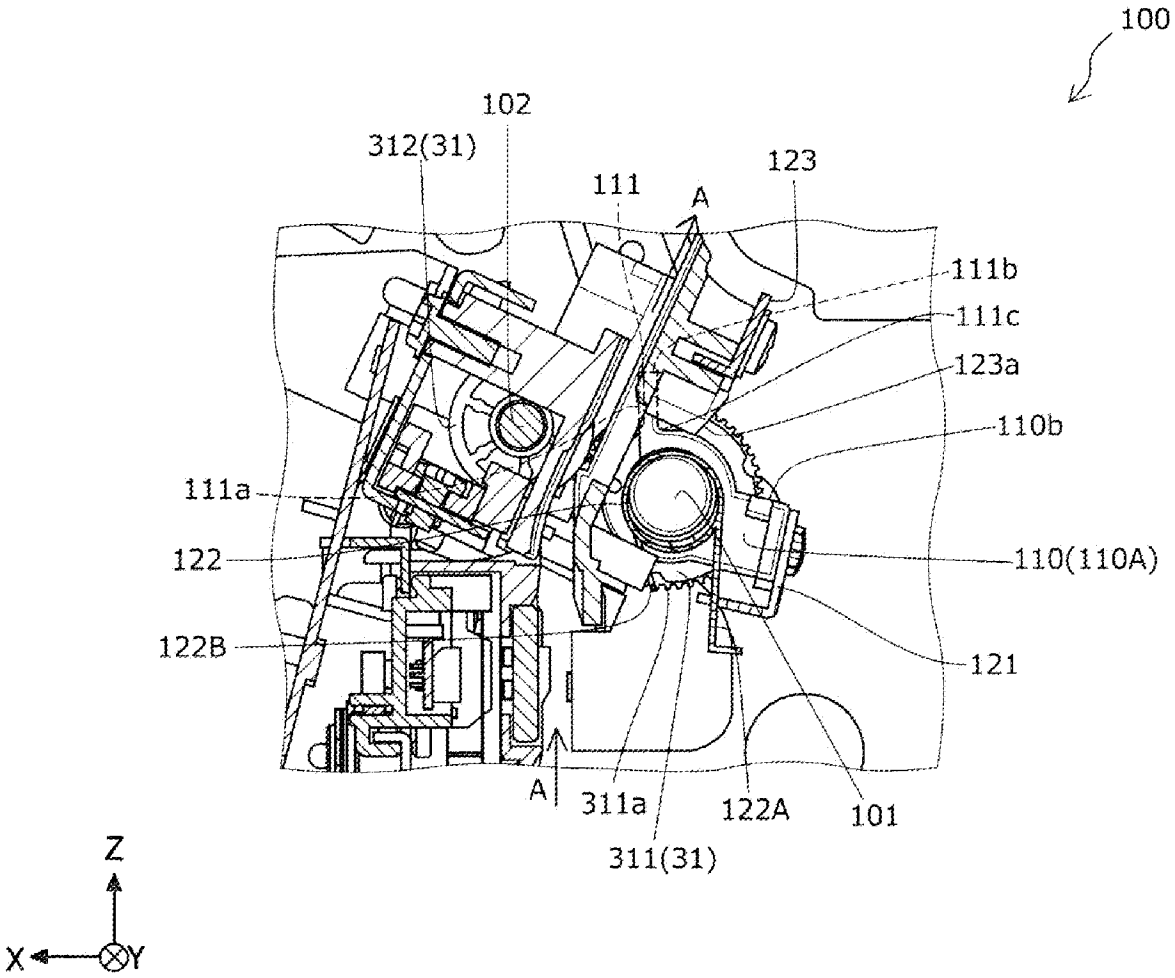
FIG. 4 is a front cross-sectional view illustrating the skew correction portion of the printer of FIG. 1 and a view illustrating a state in which the contact portion is at a position not in contact with the transported medium.

The first roller 311 and the second roller 312 are configured to be rotatable about shafts 101 and 102 extending in the Y-axis direction. The shaft 101 of the first roller 311 is provided with a buffer unit 110 that is rotatable about the shaft 101 as a rotation shaft. Note that the second roller 312 is biased toward the first roller 311. As illustrated in FIGS. 2 and 4, a buffer unit 110A according to the embodiment serving as the buffer unit 110 is provided with a contact portion 111 capable of coming into contact with the transported medium P. The contact portion 111 that comes into contact with the medium P transported when the contact portion 111 is located at the position illustrated in FIG. 2 moves to a position illustrated in FIG. 4 as the medium P is transported in the transport direction A.

Figure 3:
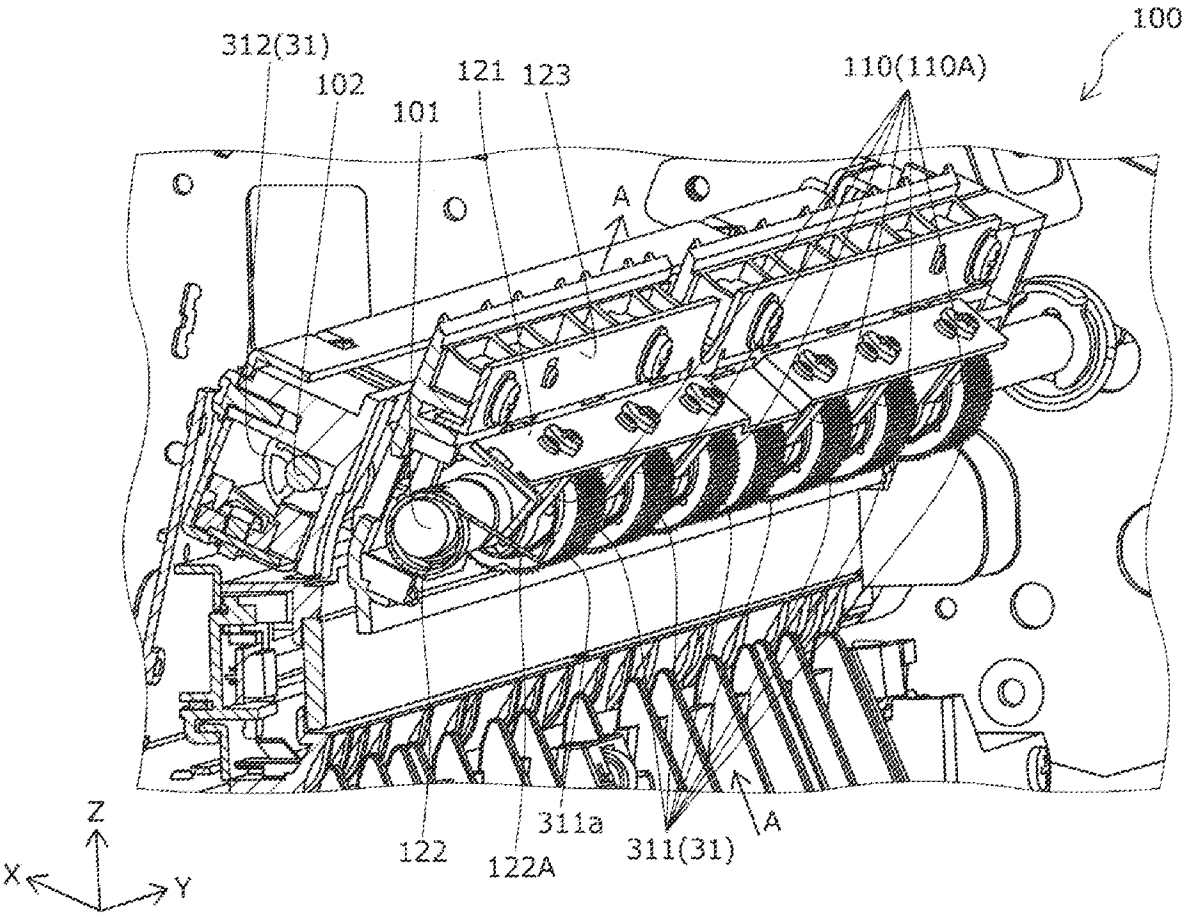
FIG. 3 is a perspective view illustrating the skew correction portion of the printer of FIG. 1 and a view illustrating a state in which the contact portion is at the position in contact with the transported medium.
Figure 5:
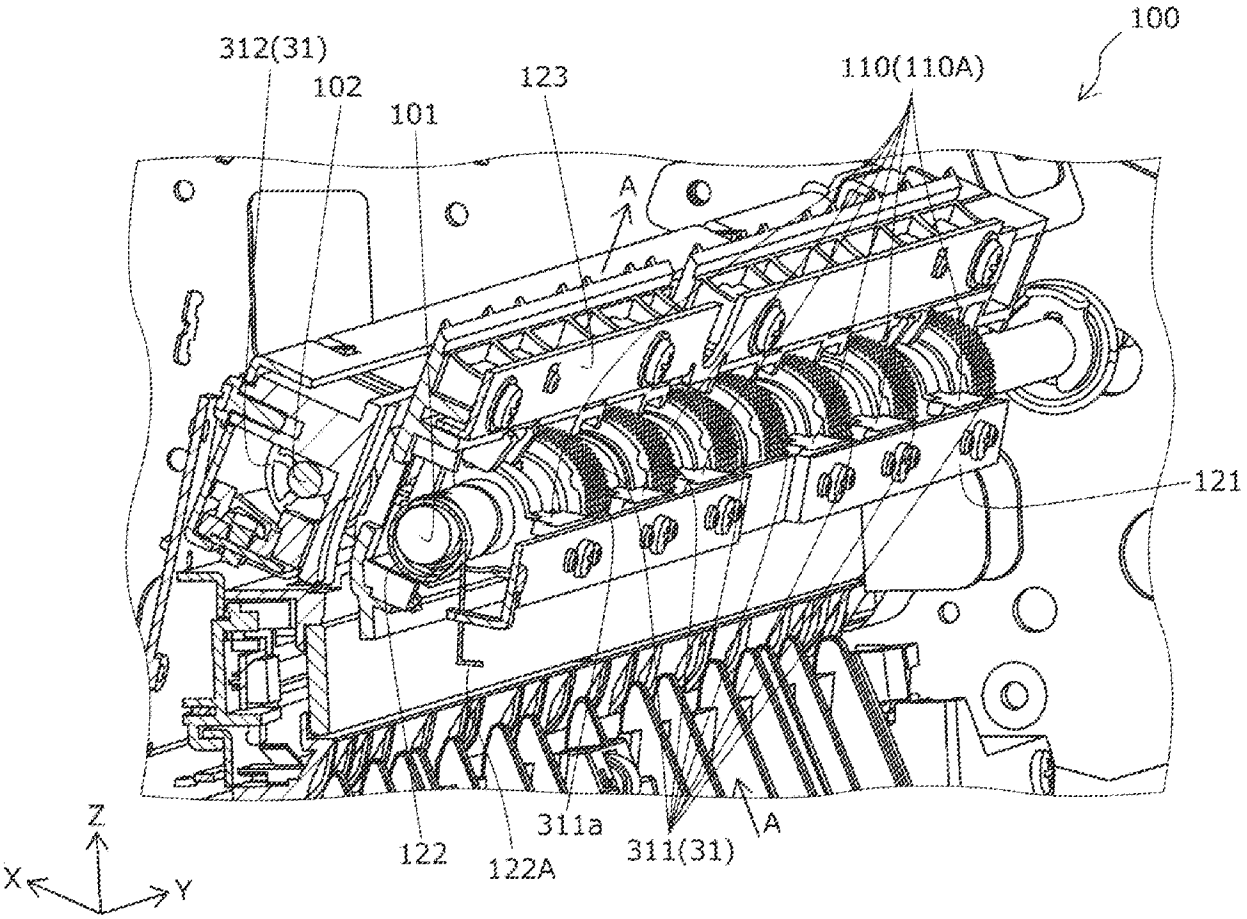
FIG. 5 is a perspective view illustrating the skew correction portion of the printer of FIG. 1 and a view illustrating a state in which the contact portion is at the position not in contact with the transported medium.

As illustrated in FIGS. 3 and 5, in the printer 1 according to the embodiment, a plurality of the buffer units 110A are formed at the shaft 101. Each of the buffer units 110A is fixed to a sheet metal member 121 and all the buffer units 110A are configured to be integrally rotatable about the shaft 101 as a rotation shaft. In addition, a helical torsion spring 122 is attached to the shaft 101, one end portion 122A of the helical torsion spring 122 is fixed to the sheet metal member 121, and the other end portion 122B of the helical torsion spring 122 is fixed to a sheet metal member 123 fixed to a frame in the printer 1.

Since the printer 1 according to the embodiment has such a configuration, due to a spring force of the helical torsion spring 122, a biasing force acts in a direction in which the sheet metal members 121 and 123 are separated from each other, that is, the biasing force acts so that the contact portion 111 that has moved to the position illustrated in FIG. 4 returns to the position illustrated in FIG. 2. In other words, the helical torsion spring 122 biases the contact portion 111 in the counterclockwise direction in FIGS. 2 and 4, that is, in the direction opposite to the transport direction A. Note that the position illustrated in FIG. 2 corresponds to an initial position of the buffer unit 110A. At the position illustrated in FIG. 2, a protruding portion 110*b* of the buffer unit 110A comes into contact with a wall portion 123*a* provided at the sheet metal member 123, whereby the posture of the buffer unit 110A is maintained.

Here, the spring force of the helical torsion spring 122 is adjusted not to be so strong that the buffer unit 110A corrects the skew of the medium P and adjusted to be so strong that the transport velocity of the transported medium P in a state of being in contact with the contact portion 111 becomes lower than when the buffer unit 110A is not provided. That is, the transport velocity of the medium P in a state of being in contact with the contact portion is adjusted to be lower than the transport velocity of the medium P when the buffer unit 110A is not provided. In other words, the buffer unit 110A is not involved in correction of the skew of the medium P. In a case where the transport velocity of the medium P when the buffer unit 110A is not provided is referred to as a first transport velocity and the transport velocity of the medium P when the medium P collides with the transport roller pair 31 after coming into contact with the contact portion 111 is referred to as a second transport velocity, the first transport velocity>the second transport velocity. Note that the transport velocity of the medium P may be a transport velocity of a part of the medium P in contact with the contact portion 111.

Here, in summary, the printer 1 according to the embodiment is a transport device that transports the medium P. The transport roller pair 31 is provided as the skew correction unit that corrects the skew of the medium P by colliding with the transported medium P. As the first transport unit that transports the medium P to the transport roller pair 31, various roller pairs such as the feed roller pairs 25, 26, and 27, the transport roller pairs 28 and 29, and the roller pair including the reversing roller 39 and the driven roller 40 are provided upstream of the transport roller pair 31 in the transport direction A. Moreover, provided is the buffer unit 110A provided with the contact portion 111 capable of coming into contact with the medium P between the first transport unit and the transport roller pair 31 in the transport direction A of the medium P. Here, the buffer unit 110A is configured such that the second transport velocity corresponding to the transport velocity of the medium P when the medium P collides with the transport roller pair 31 after coming into contact with the contact portion 111 is lower than the first transport velocity corresponding to the transport velocity of the medium P upstream of the buffer unit 110A in the transport direction A and is configured such that the contact portion 111 does not collide with the medium P strongly enough to correct the skew of the medium P.

Since the printer 1 according to the embodiment is configured in this manner, it is possible to suppress strong collision of the medium P with the transport roller pair 31 being the skew correction unit when the skew of the medium P is corrected and also suppress strong collision of the medium P with the contact portion 111 of the buffer unit 110A. Thus, the printer 1 according to the embodiment can reduce a sound made when the skew of the medium P is corrected. Note that "the contact portion 111 does not collide with the medium P strongly enough to correct the skew of the medium P" can be expressed as "the contact portion 111 decelerates the medium P while being displaced following the transported medium P rather than the contact portion 111 abuts on the medium P and stops the medium P so as to push back the medium P".

When summarized from the viewpoint of the recording device, the printer 1 according to the embodiment includes the transport device having the above-described configuration and the line head 51 serving as the recording unit that performs recording on the medium P transported by the transport device. For this reason, when recording is performed on the medium P, the printer 1 according to the embodiment can reduce a sound made when the skew of the medium P is corrected.

As described above, the buffer unit 110A according to the embodiment is configured to decelerate the medium P while the contact portion 111 is displaced following the transported medium P. That is, the buffer unit 110A serves as the contact force reduction portion that reduces a contact force when the contact portion 111 and the medium P are in contact with each other. For this reason, in the printer 1 according to the embodiment, the buffer unit 110A serving as the contact force reduction portion can suppress strong collision of the medium P with the transport roller pair 31 when the skew of the medium P is corrected and also suppress strong collision of the medium P with the contact portion 111 of the buffer unit 110A.

As described above, the buffer unit 110A includes the helical torsion spring 122 that biases the contact portion 111 in the direction opposite to the transport direction A. The contact portion 111 is biased in the direction opposite to the transport direction A by a biasing force of the elastic member such as the helical torsion spring 122 in this manner. Thus, for example, it is possible to suitably decelerate the medium P and return the contact portion 111 to the position where the contact portion 111 and the medium P start to come into contact with each other, which is the initial position as illustrated in FIG. 2. Although the helical torsion spring 122 is provided as the elastic member in the embodiment, an elastic member other than the helical torsion spring 122 may be provided.

Here, the buffer unit 110A includes a flexible member 111*a* at a position of the contact portion 111 in contact with the medium P as illustrated in FIGS. 2 and 4. By adopting a configuration in which the contact portion 111 includes the flexible member 111*a* in this manner, use of the flexible member 111*a* makes it possible to easily or inexpensively form, for example, a configuration of suitably decelerating the medium P. The type and configuration of the flexible member are not particularly limited. For example, a part of the contact portion 111 in contact with the medium P may be formed of flexible resin, or a buffer member such as sponge may be attached to a part in contact with the medium P. Further, the entire contact portion may be formed of a buffer member such as sponge.

Here, in addition to the configuration in which the flexible member 111*a* is provided at the position in contact with the medium P, the contact portion 111 may be a flexible member. In the case of such a configuration, the contact portion 111 can be returned to the initial position without an elastic member such as the helical torsion spring 122. By adopting a configuration in which the contact portion 111 is a flexible member in this manner, it is possible to easily or inexpensively form a configuration of suitably decelerating the medium P and a configuration of returning the contact portion 111 to the position (contact start position) where the contact portion 111 and the medium P start to come into contact with each other, which is the initial position.

As described above, in the printer 1 according to the embodiment, the transport roller pair 31 serving as the skew correction unit is a roller pair including the first roller 311 and the second roller 312 facing the first roller 311. Thus, the printer 1 according to the embodiment can correct the skew at the nip point of the roller pair or the like and also transport the medium to the recording-time transport path T1 by the roller pair. That is, the transport roller pair 31 serving as the skew correction unit also serves as the transport unit of the medium P.

As illustrated in FIGS. 2 and 4, the contact portion 111 is rotatable about the shaft 101 of the first roller 311. That is, the contact portion 111 is rotatable coaxially with the first roller 311. With such a configuration, it is possible to shorten the distance between the contact start position of the medium P and the contact portion 111 and the collision position of the medium P and the transport roller pair 31. For this reason, it is possible to shorten the time from when the medium P starts to come into contact with the contact portion 111 to when the medium P collides with the transport roller pair 31 and suppress a decrease in throughput. Although the contact portion and the first roller 311 are coaxial with each other but do not need to integrally rotate. The contact portion 111 may be configured to rotate coaxially with the second roller 312. In this case, the roller at the position of the second roller 312 can be regarded as the first roller, and the roller at the position of the first roller 311 can be regarded as the second roller. That is, the contact portion 111 may be configured to rotate coaxially with the driving roller driven by a motor (not illustrated) or may be configured to rotate coaxially with the driven roller that is driven to rotate in contact with the driving roller.

As illustrated in FIGS. 3 and 5, the first roller 311 is a toothed roller in contact with the medium P at a tooth portion 311*a*. In this manner, at least one of the first roller 311 or the second roller 312 can be a toothed roller that comes into contact with the medium P at the tooth portion. When the toothed roller is used as the skew correction unit, a collision sound of the medium P usually tends to be large. However, providing the buffer unit 110 can reduce a sound made when the skew of the medium P is corrected. In addition, when the transport device is used for the recording device as in the embodiment, configuring the first roller 311 as a toothed roller can suppress adherence of ink recorded on the medium P to the first roller 311, for example, when double-sided recording is performed. In addition, as described above, when the roller at the position of the second roller 312 is regarded as the first roller and the roller at the position of the first roller 311 is regarded as the second roller, configuring the second roller as a toothed roller can suppress adherence of ink recorded on the medium P to the second roller, for example, when double-sided recording is performed. Configuring at least one of the first roller 311 or the second roller 312 as a toothed roller in this manner can suppress adherence of ink recorded on the medium P to the first roller 311 or the second roller 312, for example, when double-sided recording is performed.

As illustrated in FIGS. 3 and 5, the printer 1 according to the embodiment includes a plurality of the buffer units 110A and a plurality of the first rollers 311 alternately in the axial direction of the first rollers 311. That is, the plurality of buffer units 110A and the plurality of first rollers 311 are alternately disposed in the axial direction of the first rollers 311. With such a configuration, it is possible to suitably correct the skew of the media P having various sizes and reduce a sound made when the skew of the media P is corrected. In particular, when the medium P having a large size is used, by providing the plurality of buffer units 110 and the plurality of first rollers 311 alternately in the axial direction of the first rollers 311, it is possible to suitably and effectively correct the skew of the medium P and reduce a sound made when the skew of the medium P is corrected. As long as there is a region in which the plurality of buffer units 110A and the plurality of first rollers 311 are alternately provided in the axial direction of the first rollers 311, the description "the plurality of buffer units 110A and the plurality of first rollers 311 are alternately provided in the axial direction of the first rollers 311" does not necessarily mean a configuration in which all of the buffer units 110A and the first rollers 311 are alternately provided in the axial direction of the first roller 311.

As illustrated in FIG. 1, the printer 1 according to the embodiment is provided with the plurality of transport units such as the transport belt 13 and the transport roller pairs 32, 35, 36, and 37 that further transport the medium P that has been transported by the transport roller pair 31 serving as the skew correction unit. These elements correspond to the second transport unit downstream of the skew correction unit in the transport direction A, the second transport unit being configured to transport the medium P. Here, in the printer 1 according to the embodiment, a third transport velocity that is the transport velocity of the medium P by the second transport unit after the skew is corrected by the skew correction unit is adjusted to be higher than the second transport velocity. With such a configuration, it is possible to suppress a decrease in throughput by subsequently recovering the transport velocity of the medium P while reducing a sound made when the skew of the medium P is corrected. In the embodiment, the third transport velocity is adjusted to the same velocity as the first transport velocity, but the third transport velocity is only required to be higher than the second transport velocity, and the third transport velocity may be higher than, equal to, or lower than the first transport velocity.

Embodiment 2

Figure 6:
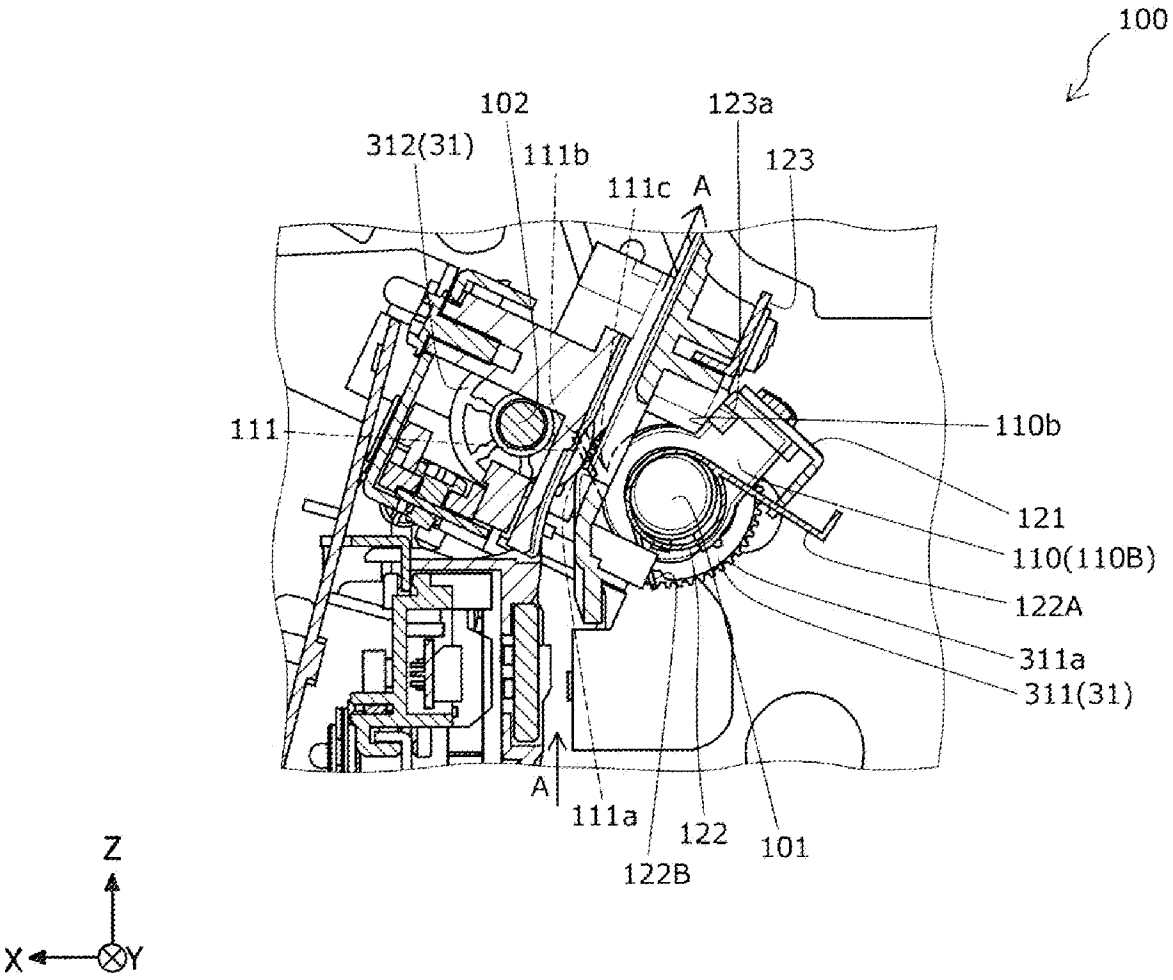
FIG. 6 is a front cross-sectional view illustrating a skew correction portion of a printer according to Embodiment 2 of the present disclosure.

Hereinafter, a printer 1 according to Embodiment 2 will be described with reference to FIG. 6. FIG. 6 is a diagram corresponding to FIG. 2 illustrating the printer 1 according to Embodiment 1. The printer 1 according to Embodiment 2 is the same as the printer 1 according to Embodiment 1 except for the configuration described below. In detail, only the configuration of the buffer unit 110 is different from that of the printer 1 according to Embodiment 1. In more detail, provided is a buffer unit 110B including a contact portion 111 having a shape different from that of the buffer unit 110A according to Embodiment 1. The printer 1 according to Embodiment 2 is different from the printer 1 according to Embodiment 1 only in this point. Thus, the printer 1 according to Embodiment 2 has the same features as the printer 1 according to Embodiment 1 except for the point described below. Thus, in FIG. 6, constituent members common to Embodiment 1 are denoted by the same reference signs, and detailed description thereof will be omitted.

As illustrated in FIG. 2, in the buffer unit 110A according to Embodiment 1, the contact portion 111 at the contact start position is configured to come into contact with the medium P such that the direction from a distal end portion 111*b* toward a proximal end portion 111*c* is substantially perpendicular to the transport direction A of the medium P. On the other hand, as illustrated in FIG. 6, in the buffer unit 110B according to Embodiment 2, the contact portion 111 at the contact start position comes into contact with the medium P in an arrangement in which the direction from a distal end portion 111*b* toward a proximal end portion 111*c* forms an acute angle with respect to the transport direction A of the medium P. In other words, in the buffer unit 110B according to Embodiment 2, the contact portion 111 extends from the proximal end portion 111*c* to the distal end portion 111*b* in contact with the medium P, and the distal end portion 111*b* extends downstream of the proximal end portion 111*c* in the transport direction A. Since the printer 1 according to Embodiment 2 has such a configuration, it is possible to suppress a situation in which the transported medium P unintentionally strongly collides with the contact portion 111 and makes a large collision sound. Further, by adopting such a configuration, it is possible to suppress a hindrance to transporting the medium P by the contact portion 111.

Embodiment 3

Figure 7:
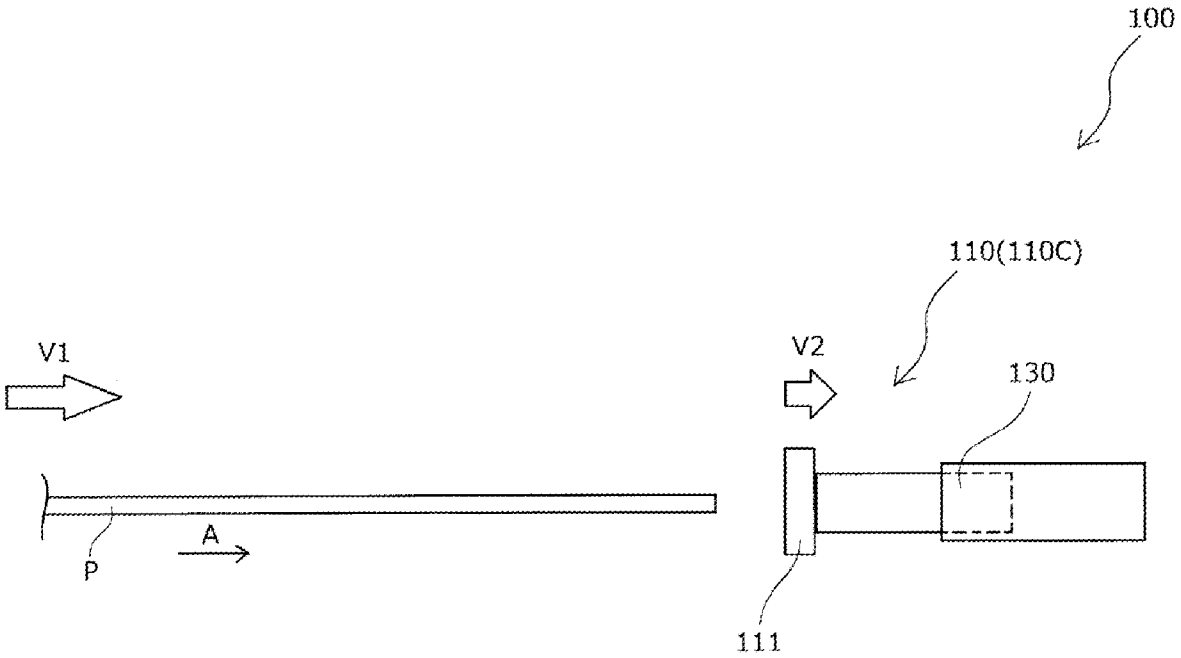
FIG. 7 is a schematic view illustrating a skew correction portion of a printer according to Embodiment 3 of the present disclosure.

Hereinafter, a printer 1 according to Embodiment 3 will be described with reference to FIG. 7. The printer 1 according to Embodiment 3 is the same as the printer 1 according to Embodiments 1 and 2 except for the configuration described below. In detail, only the configuration of the buffer unit 110 is different from that of the printer 1 according to Embodiments 1 and 2. Thus, the printer 1 according to Embodiment 3 has the same features as the printer 1 according to Embodiments 1 and 2 except for the point described below. Thus, in FIG. 7, constituent members common to Embodiments 1 and 2 are denoted by the same reference signs, and detailed description thereof will be omitted.

The buffer unit 110A according to Embodiment 1 and the buffer unit 110B according to Embodiment 2 each include the helical torsion spring 122 that is an elastic member serving as the contact force reduction portion. However, the present disclosure may include a constituent member other than the elastic member serving as the contact force reduction portion. Thus, as illustrated in FIG. 7, a buffer unit 110C according to Embodiment 3 includes, as the contact force reduction portion, a damper 130 that is coupled to the contact portion 111 and that damps the motion of the contact portion 111 in the transport direction A. As described above, even when the damper 130 is provided as the contact force reduction portion, the damper 130 can suitably decelerate the medium P from a first transport velocity V1 to a second transport velocity V2. In the configuration according to Embodiment 3, the buffer unit 110C itself can be regarded as the contact force reduction portion, and the buffer unit 110C can also be regarded as including the damper 130 serving as the contact force reduction portion. The buffer unit 110C according to Embodiment 3 moves the contact portion 111 from the contact start position, which is the initial position, to the nip position of the transport roller pair 31 along the transport path of the medium P as the medium P is transported at the second transport velocity V2. After the contact portion 111 reaches the nip position of the transport roller pair 31, the contact portion 111 passes through a position deviated from the transport path and returns to the contact start position. However, the present disclosure is not limited to the above-described configuration as long as the motion of the contact portion 111 in the transport direction A is damped by the damper.

Embodiment 4

Figure 8:
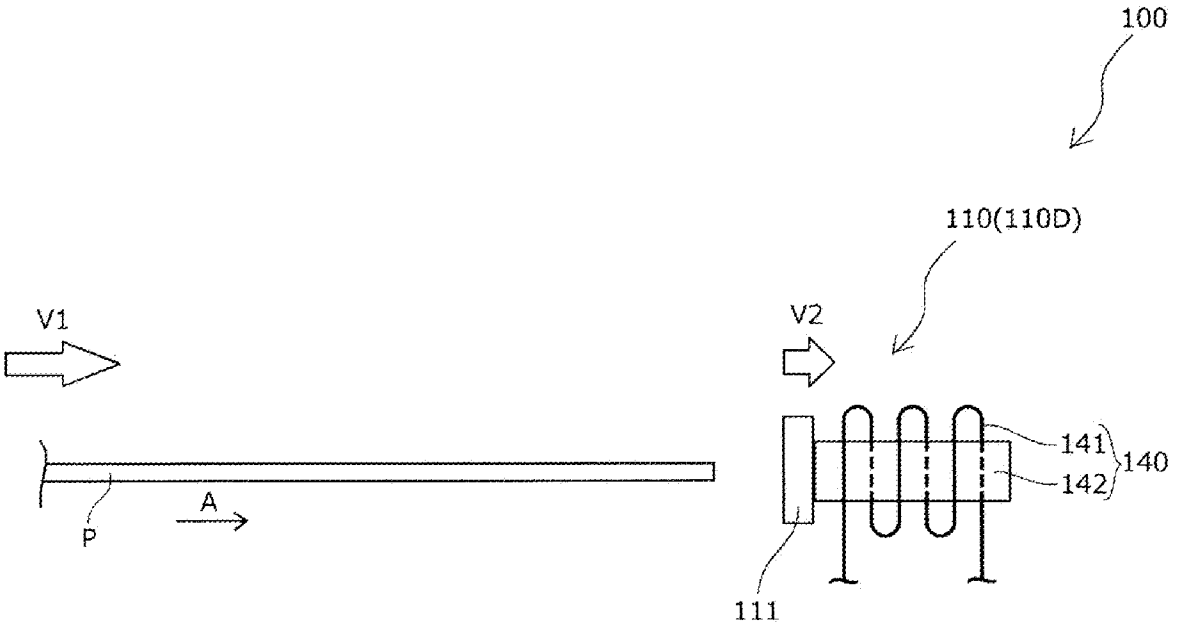
FIG. 8 is a schematic view illustrating a skew correction portion of a printer according to Embodiment 4 of the present disclosure.

Hereinafter, a printer 1 according to Embodiment 4 will be described with reference to FIG. 8. FIG. 8 is a diagram corresponding to FIG. 7 illustrating the printer 1 according to Embodiment 3. The printer 1 according to Embodiment 4 is the same as the printer 1 according to Embodiments 1 to 3 except for the configuration described below. In detail, only the configuration of the buffer unit 110 is different from that of the printer 1 according to Embodiments 1 to 3. For this reason, the printer 1 according to Embodiment 4 has the same features as the printer 1 according to Embodiments 1 to 3 except for the point described below. Thus, in FIG. 8, constituent members common to Embodiments 1 to 3 are denoted by the same reference signs, and detailed description thereof will be omitted.

As illustrated in FIG. 8, a buffer unit 110D according to Embodiment 4 includes a solenoid 140 as the contact force reduction portion. The solenoid 140 includes a three-dimensional coil 141 and a plunger 142 inserted into the three-dimensional coil 141 and coupled to the contact portion 111. When the three-dimensional coil 141 is energized, the plunger 142 moves together with the contact portion 111 relative to the three-dimensional coil 141. In other words, the buffer unit 110D according to Embodiment 4 includes the solenoid 140 as the displacement unit that moves the contact portion 111 from the contact start position where the contact portion 111 and the medium P come into contact with each other to the retraction position where the contact portion 111 and the medium P do not come into contact with each other. The solenoid 140 is configured to move the medium P along the transport path so that the transport velocity of the medium P becomes lower than the first transport velocity when the contact portion 111 is moved from the contact start position to the retraction position and is configured to return the contact portion 111 from the retraction position to the contact start position by moving the contact portion 111 in the direction opposite to the transport direction A through a position deviated from the transport path.

Since the buffer unit 110D according to Embodiment 4 has such a configuration, it is possible to suitably decelerate the medium P and return the contact portion 111 to the contact start position where the contact portion 111 and the medium P start to come into contact with each other, which is the initial position. In Embodiment 4, the solenoid 140 is configured to move the contact portion 111 so that the transport velocity of the medium P becomes the second transport velocity when the contact portion 111 is moved from the contact start position to the retraction position by energizing the solenoid 140. However, a configuration may be adopted in which the solenoid 140 is energized only when the contact portion 111 is returned from the retraction position to the contact start position, the solenoid 140 is not energized when the contact portion 111 is moved from the contact start position to the retraction position, and the contact portion 111 is moved so that the transport velocity of the medium P becomes the second transport velocity by a frictional force caused by the movement of the contact portion 111, a counter electromotive force of the solenoid, or the like. The velocity when the contact portion 111 is moved from the contact start position to the retraction position is not limited. As long as the transport velocity is lower than the first transport velocity, the movement velocity of the contact portion 111 may be higher than, lower than, or the same as the transport velocity of the medium.

In Embodiment 4, the contact portion 111 is configured to be linearly moved in the transport direction A by the solenoid 140. However, a displacement unit or the like other than the solenoid 140 may be used so that the contact portion 111 does not move linearly but rotates about, as a rotation axis, a direction intersecting the transport direction A. In the configuration according to Embodiment 4, the buffer unit 110D itself can be regarded as the contact force reduction portion, and the buffer unit 110D can also be regarded as having the displacement unit (solenoid 140) as the contact force reduction portion. Further, the present disclosure is not limited to the above-described configuration as long as the transport velocity of the medium is reduced by the displacement unit.

Embodiment 5

Figure 9:
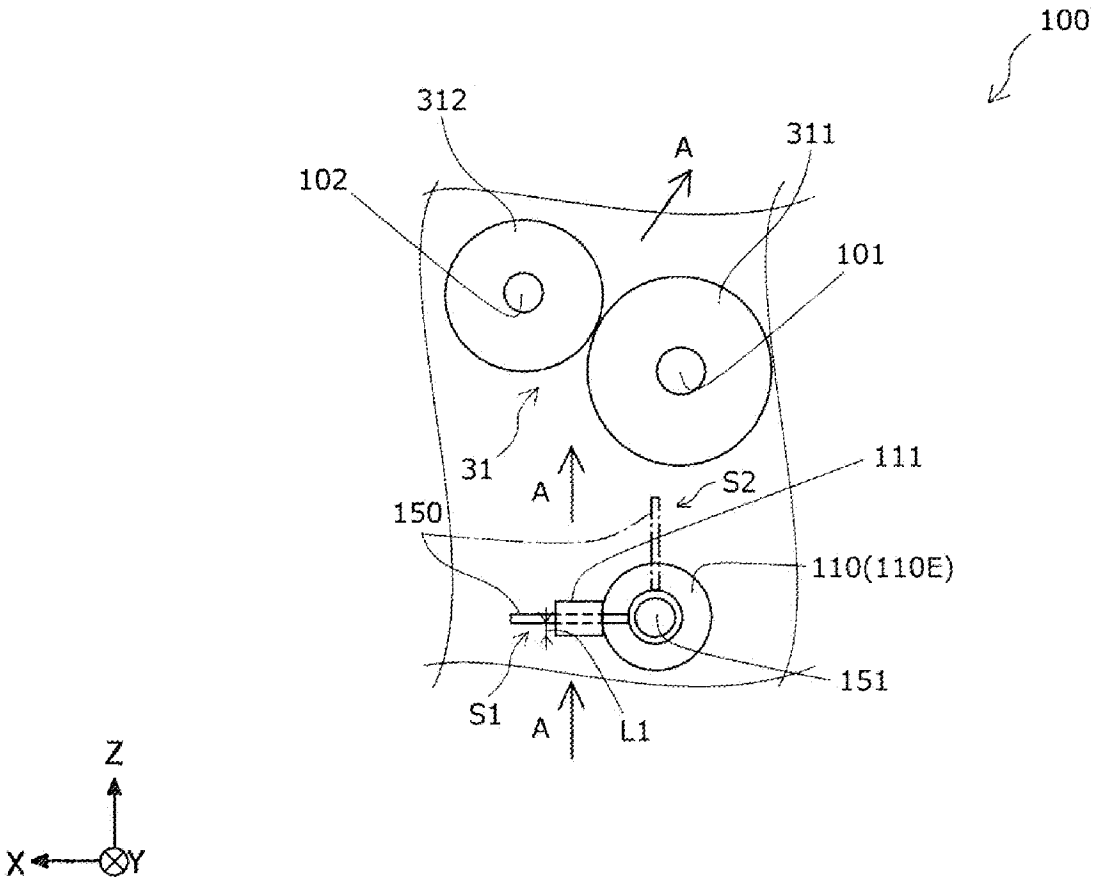
FIG. 9 is a schematic front cross-sectional view illustrating a skew correction portion of a printer according to Embodiment 5 of the present disclosure.

Hereinafter, a printer 1 according to Embodiment 5 will be described with reference to FIG. 9. The printer 1 according to Embodiment 5 is the same as the printer 1 according to Embodiments 1 to 4 except for the configuration described below. In detail, only the configuration of the skew correction portion 100 is different from that of the printer 1 according to Embodiments 1 to 4. For this reason, the printer 1 according to Embodiment 5 has the same features as the printer 1 according to Embodiments 1 to 4 except for the point described below. Thus, in FIG. 9, constituent members common to Embodiments 1 to 4 are denoted by the same reference signs, and detailed description thereof will be omitted.

In the printer 1 according to Embodiments 1 to 4, the transport roller pair 31 also serves as the skew correction unit. On the other hand, as illustrated in FIG. 9, the printer 1 according to Embodiment 5 includes a gate unit 150 as the skew correction unit. The gate unit 150 is configured to be displaced between a collision position S1, indicated by a solid line, where the transported medium P collides and a passing position S2, indicated by a dot-and-dash line, for passing the transported medium P. The skew of the transported medium P is corrected by causing the medium P transported in a state in which the gate unit 150 is located at the collision position S1 to collide with the gate unit 150, and then the medium P the skew of which has been corrected can be transported downstream in the transport direction A by locating the gate unit 150 at the passing position S2. With such a configuration, in the printer 1 according to Embodiment 5, it is possible to reduce a sound made when the skew of the medium P is corrected in the configuration of correcting the skew using the gate unit 150. In the printer 1 according to Embodiment 5, the gate unit 150 is configured to be displaced between the collision position S1 and the passing position S2 by rotating about a shaft 151 as a rotation shaft. In detail, the gate unit 150 configured to correct the skew of the medium P by coming into contact with the medium P at the collision position S1 and then move to the passing position S2 in a state of being in contact with the medium P by a force of transporting the medium P by the first transport unit such as the feed roller pair 25. However, the present disclosure is not limited to such a configuration. For example, a configuration in which the gate unit 150 is rotated using a motor or the like may be adopted, or a configuration in which the gate unit 150 can be displaced between the collision position S1 and the passing position S2 by linearly moving may be adopted.

Here, in the printer 1 according to Embodiment 5, the gate unit 150 is configured to be displaced between the collision position S1 and the passing position S2 by rotating about the shaft 151 as a rotation shaft, and a buffer unit 110E according to Embodiment 5 having the same shape as the buffer unit 110A according to Embodiment 1 is provided not at the shaft 101 of the transport roller pair 31 but at the shaft 151 of the gate unit 150. In other words, the gate unit 150 can be displaced between the collision position S1 and the passing position S2 by rotating about, as a rotation axis, the Y-axis direction that is a direction intersecting the transport direction A, and the contact portion 111 of the buffer unit 110E is rotatable coaxially with the gate unit 150. That is, in the printer 1 according to Embodiment 5, the medium P transported at the first transport velocity first comes into contact with the contact portion 111 and is transported in a state of being in contact with the contact portion 111, so that the transport velocity becomes the second transport velocity. The medium P transported at the second transport velocity collides with the gate unit 150 at the collision position S1, so that the skew is corrected. Then, the medium P is further transported in a state of being in contact with the contact portion 111 and the gate unit 150. Thus, in the printer 1 according to Embodiment 5, it is possible to shorten a distance L1 between the contact start position of the medium P and the contact portion 111 and the collision position S1 of the medium P and the gate unit 150, shorten the time from when the medium P starts to come into contact with the contact portion 111 to when the medium P collides with the gate unit 150, and suppress a decrease in throughput.

It is desirable that the contact portion 111 and the gate unit 150 be formed separately from each other. For example, when a buffer member such as a sponge is integrally provided at the gate unit 150, the buffer member may decrease the accuracy of the skew correction of the medium P colliding with the gate unit 150. Thus, by providing the contact portion 111 separately from the gate unit 150 so that the contact portion 111 comes into contact with the medium P upstream of the gate unit 150, it is possible to suppress a decrease in the accuracy of the skew correction of the medium P. However, it is also possible to adopt a configuration in which the contact portion 111 is provided at the gate unit 150 as in Embodiment 5, and in the case of such a configuration, the contact portion 111 first comes into contact with the transported medium P and thus retreats and then the medium P collides with the gate unit 150 to retreat the gate unit 150.

In addition, as described above, the gate unit 150 can be displaced between the collision position S1 and the passing position S2 by rotating about the Y-axis direction as a rotation axis. Here, the contact portion 111 is biased by a biasing unit (not illustrated) at a first biasing force in the direction opposite to the transport direction A, and the gate unit 150 is biased at a second biasing force in the direction opposite to the transport direction A by a biasing unit (not illustrated). The first biasing force is smaller than the second urging force. Since the printer 1 according to Embodiment 5 has such a configuration, it is possible to prevent, for example, the contact portion 111 from abutting on the medium P and stopping the medium P so as to push back the medium P and reduce a sound made when the skew of the medium P is corrected. With such a configuration, when the medium P is transported to a position where the medium P is not in contact with the gate unit 150 and the contact portion 111, the gate unit 150 returns to the collision position S1 and the contact portion 111 returns to the initial position.

The present disclosure is not intended to be limited to the aforementioned embodiments, and many variations are possible within the scope of the present disclosure as described in the appended claims. It goes without saying that such variations also fall within the scope of the present disclosure. For example, the present disclosure is not limited to a printer, and may be applied to a transport device of a scanner, an intermediate unit provided between various devices, a finisher, or the like.

What is claimed is:

1. A transport device for transporting a medium, the transport device comprising:

a skew correction unit configured to correct skew of the medium by colliding with the medium transported;

a first roller pair configured to transport the medium to the skew correction unit; and a buffer unit provided with a contact portion configured to come into contact with the medium between the first roller pair and the skew correction unit in a transport direction of the medium, wherein the buffer unit is configured such that a second transport velocity is lower than a first transport velocity, the first transport velocity being a transport velocity of the medium upstream of the buffer unit in the transport direction, the second transport velocity being a transport velocity of the medium when the medium collides with the skew correction unit after coming into contact with the contact portion and the buffer unit is configured such that the contact portion does not collide with the medium strongly enough to correct the skew of the medium.

2. The transport device according to claim 1, wherein the buffer unit includes a contact force reduction portion configured to reduce a contact force when the contact portion and the medium are in contact with each other.

3. The transport device according to claim 2, wherein the contact force reduction portion includes an elastic member configured to bias the contact portion in a direction opposite to the transport direction.

4. The transport device according to claim 3, wherein the skew correction unit is a gate unit configured to be displaced between a collision position where the medium transported collides with the gate unit and a passing position for passing the medium transported, the gate unit is configured to be displaced between the collision position and the passing position by rotating about, as a rotation axis, a direction intersecting the transport direction, the contact portion is biased by the contact force reduction portion at a first biasing force in a direction opposite to the transport direction, the gate unit is biased at a second biasing force in a direction opposite to the transport direction, and the first biasing force is smaller than the second biasing force.

5. The transport device according to claim 2, wherein the contact force reduction portion includes a damper configured to damp a motion of the contact portion in the transport direction.

6. The transport device according to claim 2, wherein the contact force reduction portion includes a displacement unit configured to move the contact portion from a contact start position where the contact portion and the medium come into contact with each other to a retraction position where the contact portion and the medium do not come into contact with each other and the displacement unit is configured to move the contact portion such that the transport velocity of the medium is a transport velocity lower than the first transport velocity when the contact portion is moved from the contact start position to the retraction position and is configured to return the contact portion from the retraction position to the contact start position.

7. The transport device according to claim 2, wherein the contact force reduction portion includes a flexible member.

8. The transport device according to claim 1, wherein the skew correction unit is a roller pair including a first roller and a second roller facing the first roller.

9. The transport device according to claim 8, wherein the contact portion is configured to rotate coaxially with the first roller.

10. The transport device according to claim 8, wherein at least one of the first roller or the second roller is a toothed roller configured to come into contact with the medium at a tooth portion.

11. The transport device according to claim 8, wherein a plurality of the buffer units and a plurality of the first rollers are alternately arranged in an axial direction of the plurality of first rollers.

12. The liquid ejection apparatus according to claim 8, wherein a plurality of the buffer units and a plurality of the first rollers are alternately arranged in an axial direction of the plurality of the first rollers with at least one buffer unit of the plurality of buffer units disposed between two first rollers of the plurality of first rollers.

13. The transport device according to claim 1, wherein the skew correction unit is a gate unit configured to be displaced between a collision position where the medium transported collides with the gate unit and a passing position for passing the medium transported.

14. The transport device according to claim 13, wherein the gate unit is configured to be displaced between the collision position and the passing position by rotating about, as a rotation axis, a direction intersecting the transport direction and the contact portion is configured to rotate coaxially with the gate unit.

15. The transport device according to claim 1, wherein the contact portion extends from a proximal end portion to a distal end portion configured to come into contact with the medium and the distal end portion extends downstream of the proximal end portion in the transport direction.

16. The transport device according to claim 1, further comprising a second roller pair downstream of the skew correction unit in the transport direction, the second roller pair being configured to transport the medium, wherein a third transport velocity is higher than the second transport velocity, the third transport velocity being a transport velocity of the medium by the second roller pair after the skew is corrected by the skew correction unit.

17. A recording device comprising:

the transport device according to claim 1; and a recording unit configured to perform recording on the medium transported by the transport device.

18. The liquid ejection apparatus according to claim 1, wherein the buffer unit comprising a plurality of first buffer units connected together by a member, the plurality of first buffer units being integrally rotatable together about a shaft.

* * * * *